US009165532B2

(12) United States Patent
Ijima

(10) Patent No.: US 9,165,532 B2
(45) **Date of Patent: *Oct. 20, 2015**

(54) DISPLAY DEVICE

(71) Applicant: Mitsubishi Electric Corporation, Tokyo (JP)

(72) Inventor: Yukio Ijima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/268,284

(22) Filed: May 2, 2014

(65) Prior Publication Data

US 2014/0347348 A1 Nov. 27, 2014

(30) Foreign Application Priority Data

May 23, 2013 (JP) ..... 2013-108593

(51) Int. Cl.
*G09G 5/00* (2006.01)
*G09G 5/18* (2006.01)
*G09G 3/36* (2006.01)

(52) U.S. Cl.
CPC ..... *G09G 5/18* (2013.01); *G09G 3/3674* (2013.01); *G09G 3/3685* (2013.01)

(58) Field of Classification Search
CPC ..... G09G 5/00; G09G 3/20; G09G 3/3677; G09G 3/3648; G09G 3/36; G09G 3/3611; G09G 2300/0408; G09G 2370/08
USPC ..... 345/213, 211, 204, 100, 87, 691
See application file for complete search history.

(56) References Cited

U.S. PATENT DOCUMENTS

| | | | | |
|---|---|---|---|---|
| 2009/0153541 | A1* | 6/2009 | Yusa | 345/213 |
| 2012/0127145 | A1* | 5/2012 | Jang et al. | 345/211 |
| 2012/0162291 | A1* | 6/2012 | Kim et al. | 345/691 |
| 2014/0118316 | A1* | 5/2014 | Ijima | 345/204 |

FOREIGN PATENT DOCUMENTS

| | | | |
|---|---|---|---|
| JP | 2003-323152 | A | 11/2003 |
| JP | 2008-292926 | A | 12/2008 |
| JP | 2010-190932 | A | 9/2010 |

* cited by examiner

*Primary Examiner* — Olga Merkoulova
(74) *Attorney, Agent, or Firm* — Studebaker & Brackett PC

(57) ABSTRACT

Each of image-signal-line drive circuits includes a timing controller that generates a control signal controlling itself and other image-signal-line drive circuit, and a master/slave selection circuit that sets itself as a master mode image-signal-line drive circuit or a slave mode image-signal-line drive circuit based on a selection signal to be given from outside. From among the plurality of image-signal-line drive circuits, the master mode image-signal-line drive circuit gives the control signal to the slave mode image-signal-line drive circuit.

10 Claims, 11 Drawing Sheets

DISPLAY DEVICE

BACKGROUND OF THE INVENTION

1. Field of the Invention

The present invention relates to display devices such as liquid crystal display devices, and particularly to an active-matrix display device.

2. Description of the Background Art

These days, display devices, such as liquid crystal display devices, are used in a wide field of application from home TVs to industrial displays.

For example, a configuration of a liquid crystal display device is roughly classified into a liquid crystal panel and a drive unit that drives the liquid crystal panel. A conventional drive unit includes a plurality of image-signal-line drive circuits, a plurality of scanning line drive circuits, and a timing controller that serves as a control circuit for driving these drive circuits.

Each image-signal-line drive circuit is an integrated circuit for driving the image signal lines of the liquid crystal panel. The plurality of integrated circuits are used to drive all the image signal lines of the liquid crystal panel. Similarly, each scanning line drive circuit is an integrated circuit for driving the scanning lines of the liquid crystal panel. The plurality of integrated circuits are used to drive all the scanning lines of the liquid crystal panel.

The timing controller receives image data, control reference signals that serve as a reference for controlling the image-signal-line drive circuit and the scanning line drive circuit, and a dot clock (DCLK) that serves as a reference for performing processes. The above-described control reference signals include signals such as a horizontal synchronizing signal (HD) used as a reference signal for horizontal synchronization of the liquid crystal panel, a vertical synchronizing signal (VD) used as a reference signal for vertical synchronization of the liquid crystal panel, and a data enable signal (DENA) that indicates a period in which the image data is valid.

These days, as disclosed in Japanese Patent Application Laid-Open No. 2010-190932, an image-signal-line drive circuit in which a timing controller is installed (incorporated) has been developed. Since such an image-signal-line drive circuit eliminates the need for a circuit substrate for the timing controller, it is possible to reduce material costs. This results in achievement of low pricing of liquid crystal display devices.

The liquid crystal display device is provided with the plurality of image-signal-line drive circuits in each of which the timing controller is incorporated. One timing controller in itself, however, will suffice. Accordingly, one of the plurality of image-signal-line drive circuits is used in master mode. The remaining image-signal-line drive circuit is used in slave mode. More specifically, the master mode image-signal-line drive circuit operates based on its timing controller. The slave mode image-signal-line drive circuit receives the control signal from the timing controller of the master mode image-signal-line drive circuit and operates. In this case, it is possible to reduce power consumption by suspending the timing controller of the slave mode image-signal-line drive circuit.

SUMMARY OF THE INVENTION

The image-signal-line drive circuit in which the timing controller is incorporated has expanded into the consumer market, such as a tablet terminal and a notebook PC, for the purpose of low costs. The application is expected to expand further, such as automotive devices.

As described above, however, functions of the slave mode image-signal-line drive circuit are suspended or limited to some operations, and do not work effectively.

There is provided a display device that effectively utilizes functions of the slave mode image-signal-line drive circuit to enable reception and display of a plurality of input signals.

A display device according to the present invention includes a display panel in which a plurality of image signal lines and a plurality of scanning lines are formed in a matrix, a plurality of image-signal-line drive circuits disposed on a periphery of the display panel, the plurality of image-signal-line drive circuits driving the plurality of image signal lines, and a scanning line drive circuit disposed on a periphery of the display panel, the scanning line drive circuit driving the plurality of scanning lines, each of the plurality of image-signal-line drive circuits having a timing controller that generates a control signal controlling itself and other image-signal-line drive circuits, and a master/slave selection circuit that sets itself as either a master mode image-signal-line drive circuit or a slave mode image-signal-line drive circuit based on a selection signal given from outside, wherein, from among the plurality of image-signal-line drive circuits, the master mode image-signal-line drive circuit gives the control signal to the slave mode image-signal-line drive circuit.

According to the above-described display device, any one of the image-signal-line drive circuits operates as a master based on the selection signal given from outside. This makes it possible to give input signals different from each other to the plurality of image-signal-line drive circuits and to switch and display the plurality of input signals on the display device by the selection signal.

These and other objects, features, aspects and advantages of the present invention will become more apparent from the following detailed description of the present invention when taken in conjunction with the accompanying drawings.

DESCRIPTION OF THE PREFERRED EMBODIMENTS

<Introduction>

Prior to description of preferred embodiments, a liquid crystal display device including a plurality of image-signal-line drive circuits each incorporating a timing controller, and operation of a master mode and a slave mode in the plurality of image-signal-line drive circuits will be described.

Figure 1:
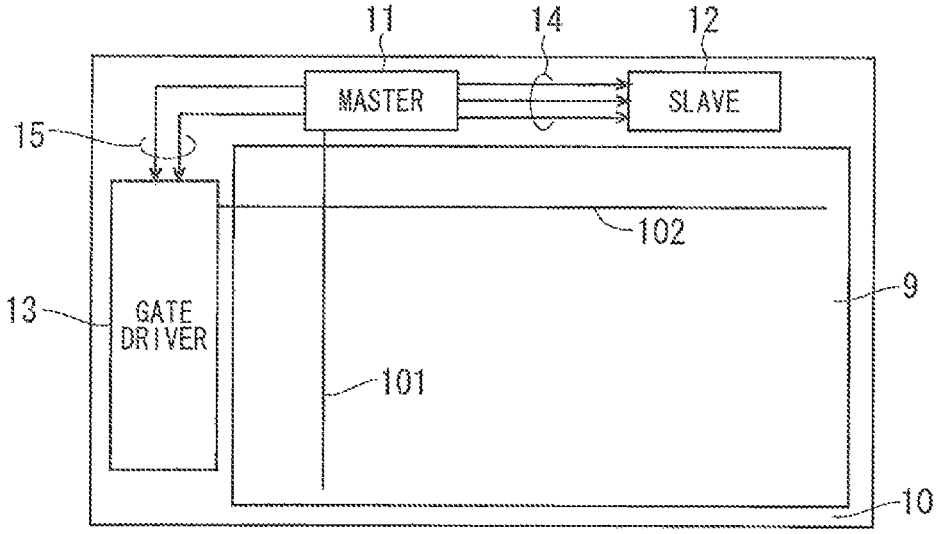
FIG. 1 is a block diagram illustrating a schematic configuration of a liquid crystal display device.

FIG. 1 is a block diagram illustrating a schematic configuration of a liquid crystal display device 10. FIG. 1 illustrates a peripheral circuit for driving a liquid crystal panel 9 in which an image signal line 101 and a scanning line 102 are formed in a matrix. The liquid crystal display device 10 is an active-matrix display device in which an active device, such as a thin film transistor (TFT), is provided at an intersection between the image signal line 101 and the scanning line 102. Since this configuration is conventional, the description thereof will be omitted. Although the following description will be made as a liquid crystal display device, the present invention is applicable to any active-matrix display device. The present invention is not limited to a liquid crystal display device, but is applicable to displays such as a plasma display and an organic electroluminescence display.

Image-signal-line drive circuits 11 and 12 for driving the image signal line 101, and a scanning line drive circuit 13 (referred to as "gate driver") for driving the scanning line 102 are provided on a periphery of the liquid crystal panel 9. FIG. 1 illustrates only two image-signal-line drive circuits and one scanning line drive circuit for convenience. Practically, however, a large number of respective circuits are disposed.

Each of the image-signal-line drive circuits 11 and 12 incorporates the timing controller. In this example, the image-signal-line drive circuit 11 is a master mode image-signal-line drive circuit (referred to as "master"), and the image-signal-line drive circuit 12 is a slave mode image-signal-line drive circuit (referred to as "slave").

The image-signal-line drive circuit 11 is configured to receive, from outside, control reference signals including a dot clock (DCLK) that serves as a reference for performing processes, a horizontal synchronizing signal (HD) used as a reference signal for horizontal synchronization of the liquid crystal panel, a vertical synchronizing signal (VD) used as a reference signal for vertical synchronization of the liquid crystal panel, and a data enable signal (DENA) that indicates a period in which image data is valid. Based on these control reference signals, the image-signal-line drive circuit 11 then generates a control signal that controls the image-signal-line drive circuit 12. The image-signal-line drive circuit 11 then gives the control signal to the image-signal-line drive circuit 12 via a wiring unit 14. The image-signal-line drive circuit 11 also generates a control signal that controls the scanning line drive circuit 13 and gives the control signal to the scanning line drive circuit 13 via a wiring unit 15.

Figure 2:
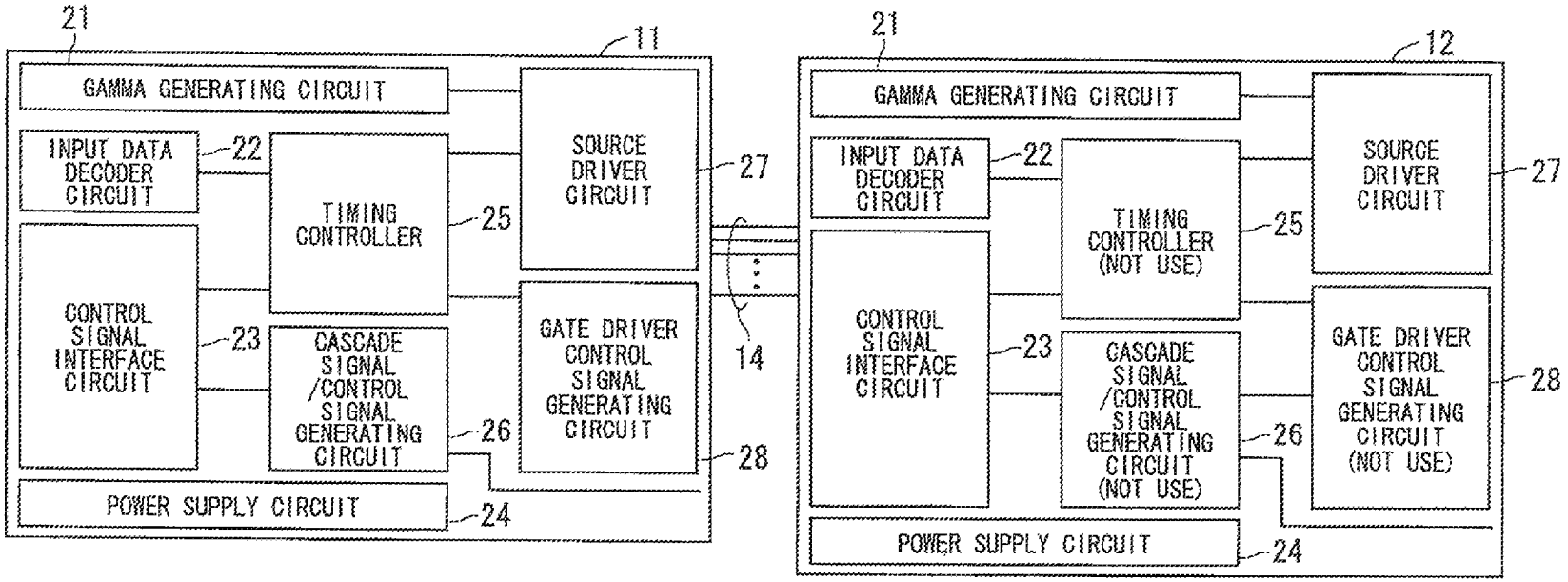
FIG. 2 is a block diagram illustrating an internal configuration of an image-signal-line drive circuit.

FIG. 2 is a block diagram illustrating an internal configuration of the image-signal-line drive circuits 11 and 12. Both of the drive circuits, which have the same configuration, use the same reference numerals.

As illustrated in FIG. 2, the image-signal-line drive circuit 11 (and 12) includes a gamma generating circuit 21, an input data decoder circuit 22, a control signal interface circuit 23, a power supply circuit 24, a timing controller 25, a cascade signal/control signal generating circuit 26, a source driver circuit 27, and a gate driver control signal generating circuit 28.

The timing controller 25 is a circuit connected with the input data decoder circuit 22 and the control signal interface circuit 23. The timing controller 25 receives the image data, the control reference signal that serves as a reference for controlling the image-signal-line drive circuit and the scanning line drive circuit, and the dot clock that serves as a reference for performing processes. The timing controller 25 generates the control signal to be given to the source driver circuit 27 and the gate driver control signal generating circuit 28.

The gamma generating circuit 21 is a circuit that performs gamma correction for the image data. The input data decoder circuit 22 is a circuit that decodes input data. The control signal interface circuit 23 is an interface circuit for the control signal.

The cascade signal/control signal generating circuit 26 is a circuit that generates a cascade signal that controls a plurality of cascaded shift registers in the scanning line drive circuit. The cascade signal is given to the scanning line drive circuit 13.

The source driver circuit 27 is a circuit that drives the image signal lines. The gate driver control signal generating circuit 28 is a circuit that generates a gate control signal to be given to the scanning line drive circuit 13.

In FIG. 2, the image-signal-line drive circuits 11 and 12 are connected to each other via the wiring unit 14. The image-signal-line drive circuit 12 operates as a slave. Accordingly, the timing controller 25, cascade signal/control signal generating circuit 26, and gate driver control signal generating circuit 28 of the image-signal-line drive circuit 12 are not used.

Figure 3:
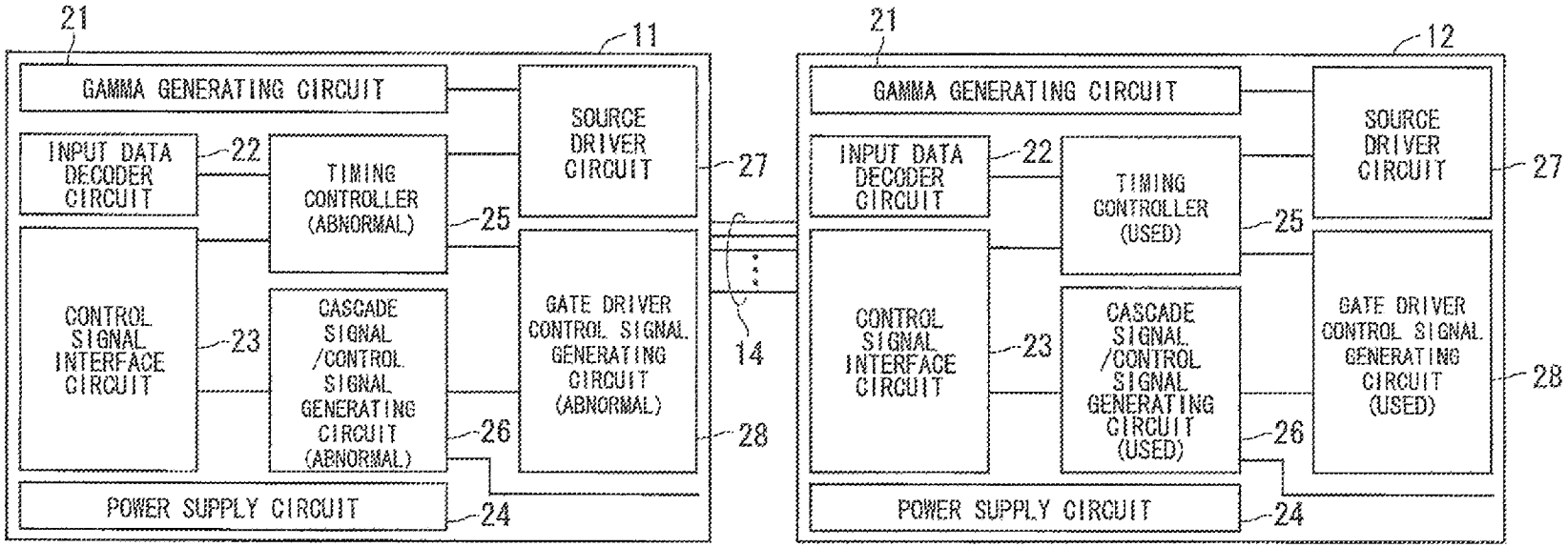
FIG. 3 is a diagram illustrating backup by a slave image-signal-line drive circuit when an abnormality occurs in a master image-signal-line drive circuit.

However, as illustrated in FIG. 3, when an abnormality occurs in any one of the timing controller 25, cascade signal/control signal generating circuit 26, and gate driver control signal generating circuit 28 of the image-signal-line drive circuit 11, the timing controller 25, cascade signal/control signal generating circuit 26, and gate driver control signal generating circuit 28 of the slave side image-signal-line drive circuit 12 will be used, and the image-signal-line drive circuit 12 will be a master mode.

<First Preferred Embodiment>

Hereinafter, as a first preferred embodiment according to the present invention, a configuration will be described in which an input signal is given to a plurality of image-signal-line drive circuits, and a selection signal from outside selects any one of the image-signal-line drive circuits as a master mode image-signal-line drive circuit (as a master).

Figure 4:
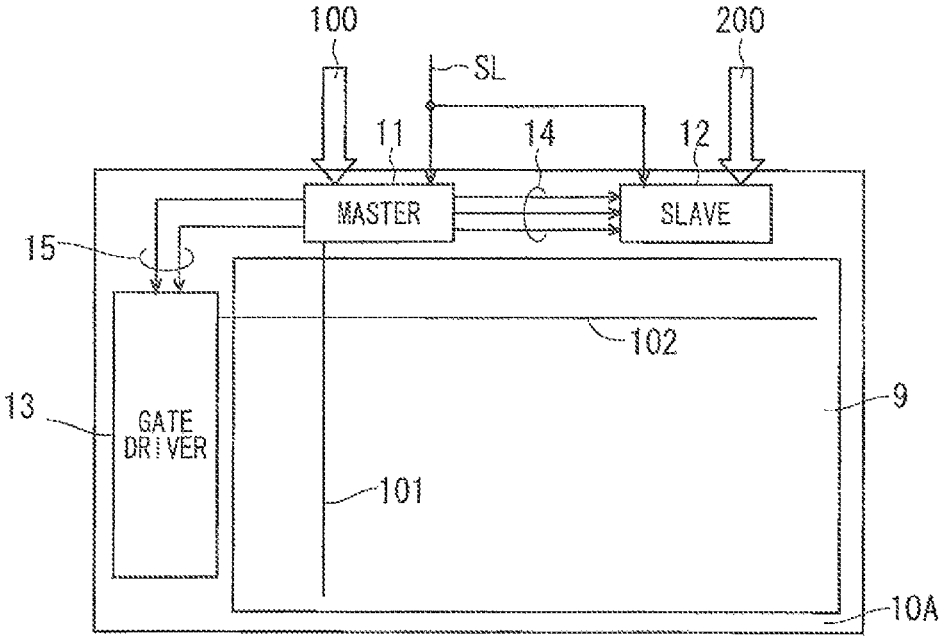
FIG. 4 is a block diagram illustrating a schematic configuration of the liquid crystal display device according to a first preferred embodiment of the present invention.

FIG. 4 is a block diagram illustrating a schematic configuration of a liquid crystal display device 10A in which an input signal is given to each of the image-signal-line drive circuits 11 and 12. Components identical to those in the liquid crystal display device 10 illustrated in FIG. 1 are assigned with identical reference numerals.

The liquid crystal display device 10A is configured so that control reference signals including the above-described DCLK, HD, VD, and DENA are given from outside to the image-signal-line drive circuits 11 and 12 as input signals 100 and 200, respectively. The liquid crystal display device 10A is also configured so that a selection signal SL that selects which of the image-signal-line drive circuits 11 and 12 becomes a master is given.

The input signals 100 and 200 are given in accordance with various interface standards, such as complementary metal oxide semiconductor (CMOS), low voltage differential signaling (LVDS), mobile industry processor interface (Mipi), and digital visual interface (DVI).

Figure 5:
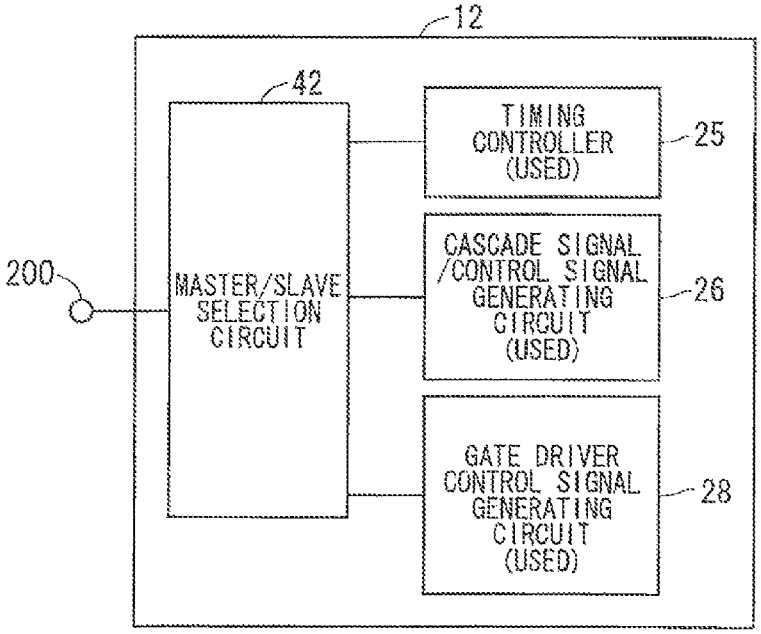
FIG. 5 is a block diagram illustrating operation of a master/slave selection circuit.

FIG. 5 is a block diagram illustrating a function of a master/slave selection circuit 42 included in the image-signal-line drive circuit 12. The master/slave selection circuit 42 is a circuit that receives the selection signal SL from outside, and selects the image-signal-line drive circuit 12 as a slave mode or master mode image-signal-line drive circuit. The master/slave selection circuit 42 is configured so that the selection signal is given to a timing controller 25, a cascade signal/control signal generating circuit 26, and a gate driver control signal generating circuit 28. These circuits to which the selection signal is given will operate in master mode. The example of FIG. 5 illustrates a case where the selection signal SL is given so that the image-signal-line drive circuit 12 is selected as a master.

Figure 6:
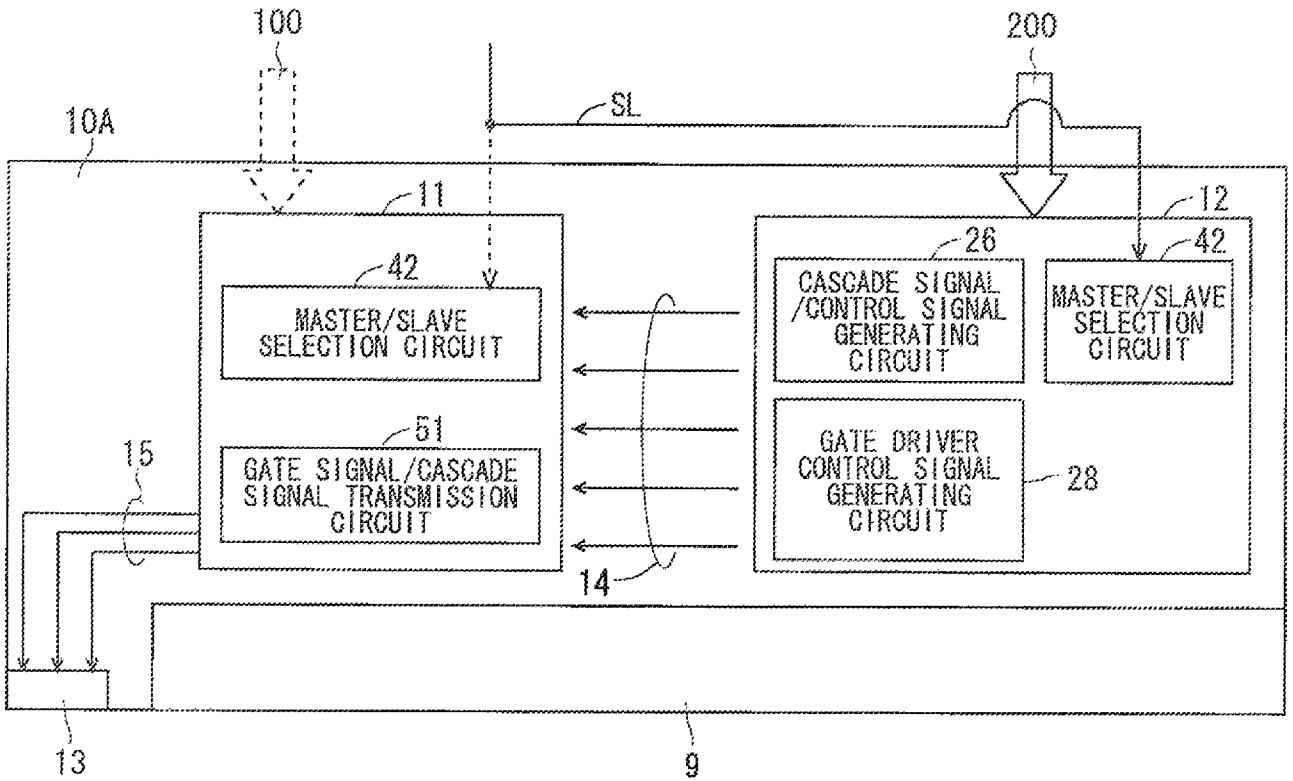
FIG. 6 is a diagram illustrating a configuration of the image-signal-line drive circuit and a signal flow in the liquid crystal display device according to the first preferred embodiment of the present invention.

FIG. 6 is a diagram illustrating a configuration of the image-signal-line drive circuits 11 and 12, and a signal flow in the liquid crystal display device 10A of the first preferred embodiment. As illustrated in FIG. 6, the image-signal-line drive circuit 11 also has the identical master/slave selection circuit 42. When the selection signal SL is given so that the image-signal-line drive circuit 11 is selected as a master, the image-signal-line drive circuit 11 operates in master mode. In the example of FIG. 6, since the selection signal SL is given so that the image-signal-line drive circuit 12 is selected as a master, the selection signal SL given to the image-signal-line drive circuit 11 is illustrated by a dashed line.

In the image-signal-line drive circuit 12 that operates as a master, based on the input signal 200, the cascade signal/control signal generating circuit 26 generates the cascade signal, and the gate driver control signal generating circuit 28 generates the gate control signal. The cascade signal and the gate control signal are given via the wiring unit 14 to the image-signal-line drive circuit 11 that operates as a slave. The cascade signal and the gate control signal are given to the scanning line drive circuit 13 through the gate signal/cascade signal transmission circuit 51 in the image-signal-line drive circuit 11.

Such a configuration makes it possible to give the cascade signal and the gate control signal to the scanning line drive circuit 13, whichever image-signal-line drive circuit becomes a master.

On the other hand, the input signal 100 is given to the image-signal-line drive circuit 11 that operates as a slave. However, since the image-signal-line drive circuit 11 does not operate as a master even when the image-signal-line drive circuit 11 receives the input signal 100, the input signal 100 to be given to the image-signal-line drive circuit 11 is illustrated by a dashed line.

The input signals 100 and 200 may be simultaneously given to the image-signal-line drive circuits 11 and 12, respectively, but may be given in different timing synchronizing with the selection signal SL.

In this way, according to the liquid crystal display device 10A of the first preferred embodiment of the present invention, the selection signal SL from outside causes any one of the image-signal-line drive circuits to operate as a master, to generate the cascade signal and the gate control signal, and to control the scanning line drive circuit 13. This makes it possible to give input signals different from each other to the plurality of image-signal-line drive circuits, and to switch and display a plurality of input signals on the liquid crystal display device 10A by the selection signal SL. For example, when there are a plurality of external instruments, such as camcorders, it is possible to operate to switch different images picked up by these instruments and display the images on the liquid crystal display device 10A.

<Variation>

The above-described first preferred embodiment has described the configuration in which input signals different from each other are given to a plurality of image-signal-line drive circuits. The liquid crystal display device 10A may however be configured so that an identical input signal is given to a plurality of image-signal-line drive circuits, and that the slave mode image-signal-line drive circuit is automatically switched to the master mode when an abnormality of the master mode image-signal-line drive circuit is detected. Hereinafter, the configuration will be described with reference to FIG. 7 and FIG. 8.

Figure 7:
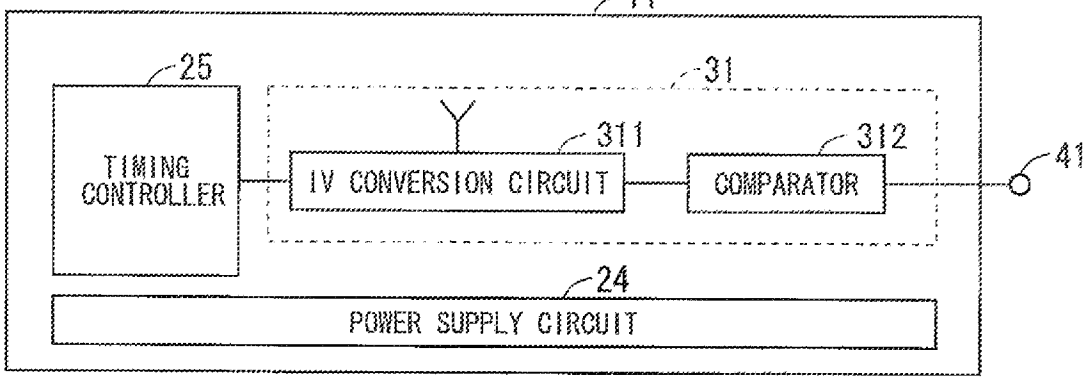
FIG. 7 is a block diagram illustrating a configuration of an abnormality detecting circuit.

FIG. 7 illustrates a configuration in which an image-signal-line drive circuit 11 includes an abnormality detecting circuit 31. The abnormality detecting circuit 31 is connected to a power input portion of a timing controller 25. The abnormality detecting circuit 31 includes an IV conversion circuit 311 that converts current consumption of the timing controller 25 into a voltage by current-voltage conversion (IV conversion) and a comparator 312.

The abnormality detecting circuit 31 is configured so that an output voltage of the IV conversion circuit 311 is given to the comparator 312 and compared with a predetermined reference voltage in the comparator 312. When the output voltage of the IV conversion circuit 311 is higher than the reference voltage, the abnormality detecting circuit 31 is configured to determine that the current consumption of the timing controller 25 has increased and to output a master/slave switching signal 41. While the configuration that detects an abnormality when the current consumption of the timing controller 25 increases has been described above, an abnormality may also be detected when the current consumption becomes smaller than a predetermined value.

The detection of an abnormality may not be limited to the timing controller 25. The abnormality detecting circuit 31 may be configured to detect an abnormality of the cascade signal/control signal generating circuit 26 or the gate driver control signal generating circuit 28.

Figure 8:
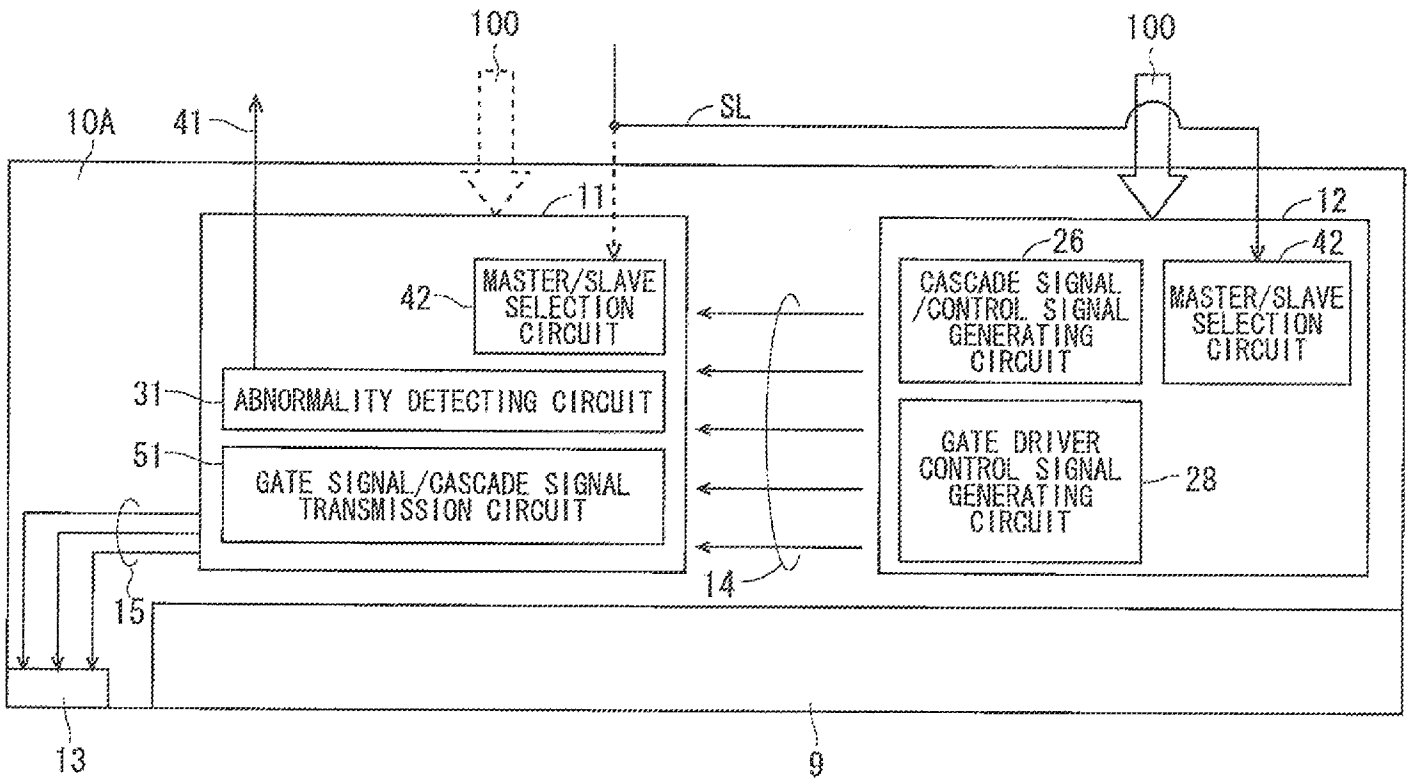
FIG. 8 is a diagram illustrating a configuration of the image-signal-line drive circuit and a signal flow in a variation of the first preferred embodiment of the present invention.

FIG. 8 illustrates a configuration in which the image-signal-line drive circuit 11 includes the abnormality detecting circuit 31. FIG. 8 illustrates a master/slave switching operation when a current consumption abnormality is detected in the image-signal-line drive circuit 11.

As illustrated in FIG. 8, the abnormality detecting circuit 31 incorporated in the image-signal-line drive circuit 11 that operates as a master detects that the current consumption of the timing controller 25 (FIG. 7) has increased, determines that the current consumption is abnormal, and outputs the master/slave switching signal 41 to an external selection signal generating unit (not illustrated). The selection signal generating unit that receives the master/slave switching signal 41 changes the selection signal SL so as to prevent the image-signal-line drive circuit 11 that outputs the master/slave switching signal 41 from being selected as a master mode image-signal-line drive circuit (so that an image-signal-line drive circuit 12 is selected as a master mode image-signal-line drive circuit).

Since the image-signal-line drive circuit 12 is selected as a master, the selection signal SL to be given to the image-signal-line drive circuit 11 is illustrated by a dashed line, as illustrated in FIG. 8.

In the image-signal-line drive circuit 12 that operates as a master, based on the input signal 100, the cascade signal/control signal generating circuit 26 generates a cascade signal, and the gate driver control signal generating circuit 28 generates a gate control signal. The image-signal-line drive circuit 12 gives these signals, via the wiring unit 14, to the image-signal-line drive circuit 11 that operates as a slave. These signals are given to the scanning line drive circuit 13 through the gate signal/cascade signal transmission circuit 51 in the image-signal-line drive circuit 11.

On the other hand, although the input signal 100 is also given to the image-signal-line drive circuit 11 that operates as a slave, since the image-signal-line drive circuit 11 does not operate as a master even if the input signal 100 is received, the input signal 100 to be given to the image-signal-line drive circuit 11 is illustrated by a dashed line.

In this way, the abnormality detecting circuit 31 detects the abnormality of the master mode image-signal-line drive circuit, and switches the slave mode image-signal-line drive circuit to master mode automatically. The image-signal-line drive circuit 12 then generates the cascade signal and the gate control signal. This enables backup operation (fail-safe) by the slave when an abnormality occurs in the master.

<Second Preferred Embodiment>

Next, as a second preferred embodiment of the present invention, a configuration will be described in which an identical input signal is given to a plurality of image-signal-line drive circuits. An input signal detecting circuit incorporated in each of the plurality of image-signal-line drive circuits detects whether the given input signal is a signal to be given to the image-signal-line drive circuit itself. When the input signal is a signal to be given to the image-signal-line drive circuit itself, the image-signal-line drive circuit operates as a master.

Figure 9:
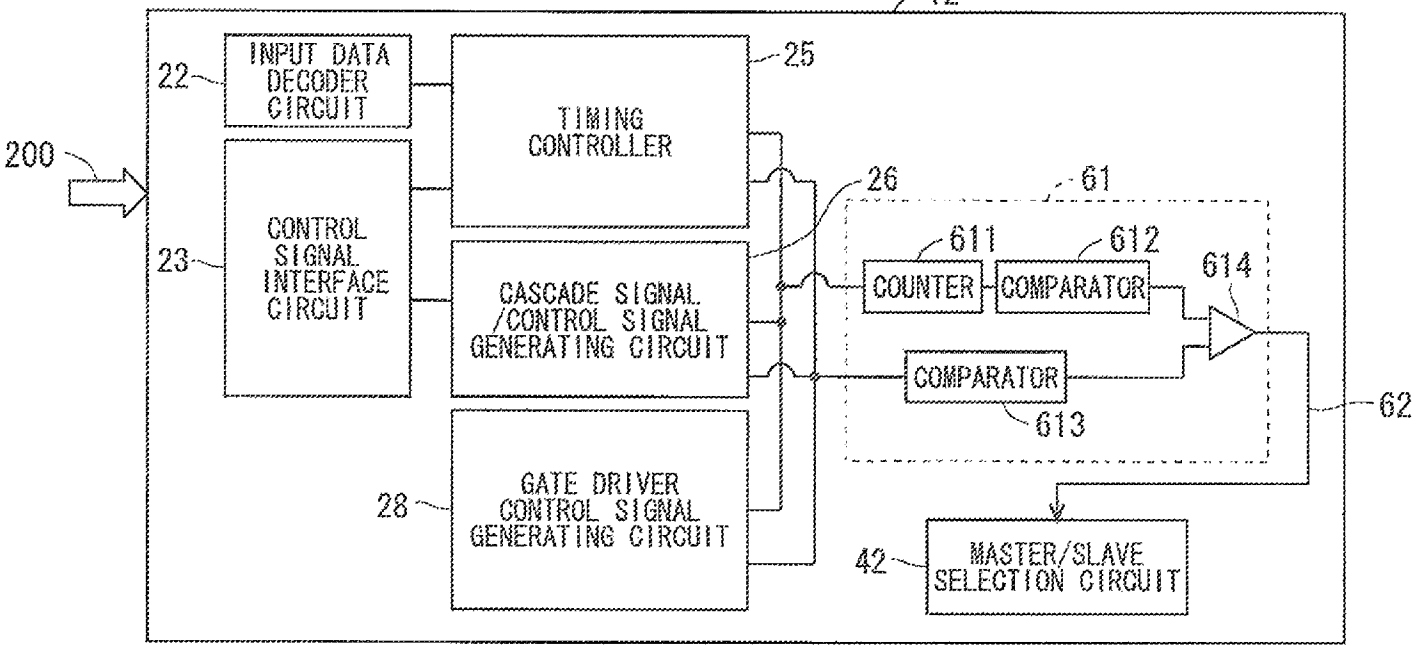
FIG. 9 is a diagram illustrating a configuration of an input signal detecting circuit included in the image-signal-line drive circuit of the liquid crystal display device according to a second preferred embodiment of the present invention.

FIG. 9 is a block diagram illustrating a configuration of an input signal detecting circuit 61 included in an image-signal-line drive circuit 12. An input signal 200 undergoes a predetermined process in an input data decoder circuit 22 and a control signal interface circuit 23. The input signal 200 is then given to a timing controller 25, a cascade signal/control signal generating circuit 26, and a gate driver control signal generating circuit 28.

An input signal detecting circuit 61 is a circuit that detects properties, such as a period and a voltage level of a control signal (generated in the timing controller 25, the cascade signal/control signal generating circuit 26, or the gate driver control signal generating circuit 28). The input signal detecting circuit 61 has a counter 611 that detects a signal period of the control signal outputted from the timing controller 25, the cascade signal/control signal generating circuit 26, and the gate driver control signal generating circuit 28. The input signal detecting circuit 61 also has a comparator 612 connected to the counter 611. The input signal detecting circuit 61 also has a comparator 613 that detects a voltage level of the control signal outputted from the timing controller 25, the cascade signal/control signal generating circuit 26, and the gate driver control signal generating circuit 28. The input signal detecting circuit 61 also has an amplifier 614 that amplifies and outputs the outputs of the comparator 612 and the comparator 613.

The input signal detecting circuit 61 is configured so that the signal period detected in the counter 611 is compared with a predetermined signal period in the comparator 612. When the signal period detected in the counter 611 is the same as the predetermined value, the input signal detecting circuit 61 is configured to determine that the control signal has been generated based on the input signal to be given to the image-signal-line drive circuit itself, and outputs a master selection signal 62 from the amplifier 614. The predetermined value is uniquely determined for each image-signal-line drive circuit.

The input signal detecting circuit 61 is configured so that the voltage level of the control signal outputted from the timing controller 25, the cascade signal/control signal generating circuit 26, and the gate driver control signal generating circuit 28 is compared with a predetermined voltage level in the comparator 613. When the voltage level of the control signal is the same as the predetermined voltage level, the input signal detecting circuit 61 is configured to determine that the control signal has been generated based on the input signal to be given to the image-signal-line drive circuit itself, and output the master selection signal 62 from the amplifier 614.

A master/slave selection circuit 42 is provided in the image-signal-line drive circuit 12, and is configured so that the master selection signal 62 is given from the input signal detecting circuit 61.

Figure 10:
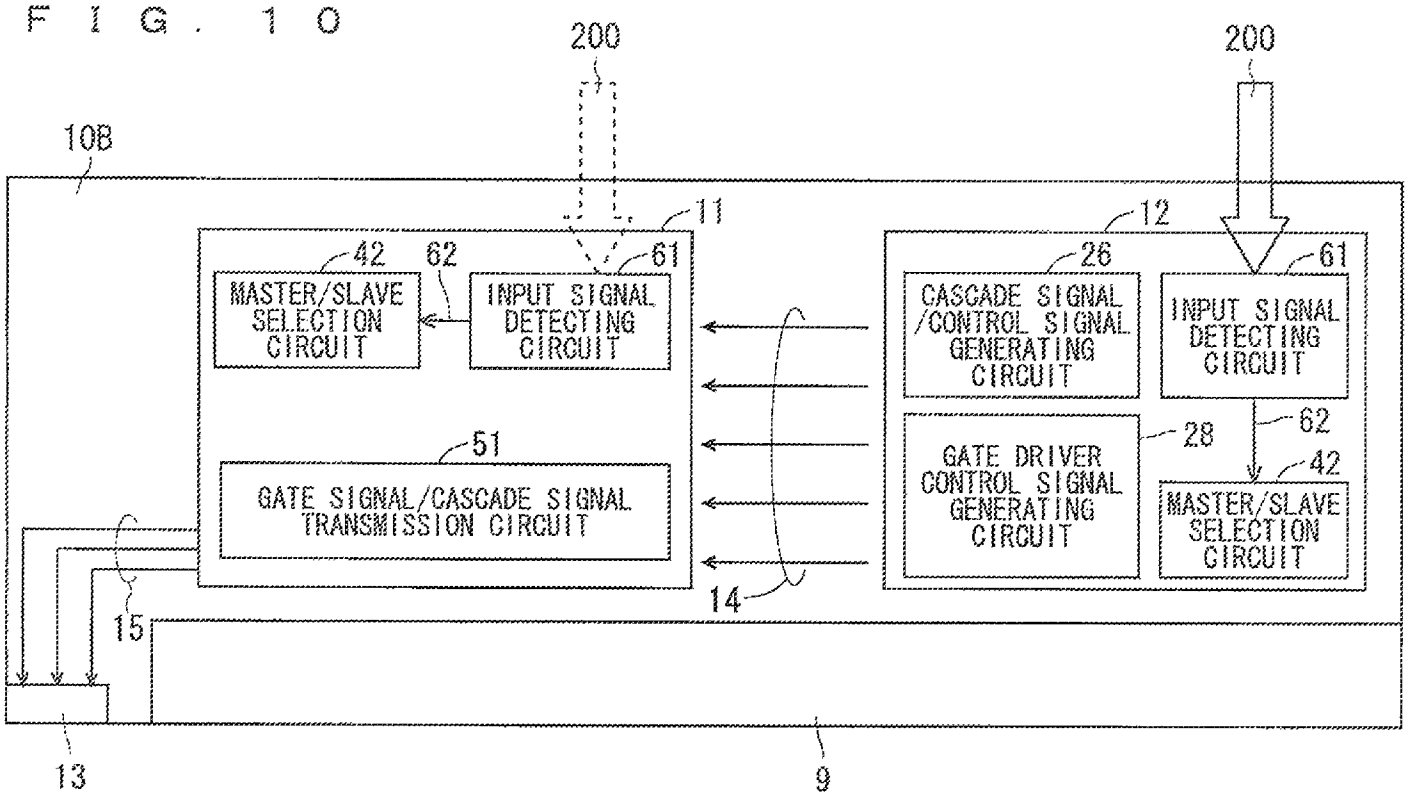
FIG. 10 is a diagram illustrating a configuration of the image-signal-line drive circuit and a signal flow in the liquid crystal display device according to the second preferred embodiment of the present invention.

FIG. 10 is a diagram illustrating a configuration of the image-signal-line drive circuits 11 and 12, and a signal flow in the liquid crystal display device 10B of the second preferred embodiment. As illustrated in FIG. 10, the master/slave selection circuit 42 to which the master selection signal 62 is given performs the operation similar to that of the first preferred embodiment. The master/slave selection circuit 42 gives, via a wiring unit 14 to the image-signal-line drive circuit 11, a cascade signal generated in the cascade signal/control signal generating circuit 26, and a gate control signal generated in the gate driver control signal generating circuit 28 of the image-signal-line drive circuit 12 that operates as a master. The cascade signal and the gate control signal are given to the scanning line drive circuit 13 through the gate signal/cascade signal transmission circuit 51 in the image-signal-line drive circuit 11.

The image-signal-line drive circuit 11 also has the identical input signal detecting circuit 61 and the master/slave selection circuit 42. When the input signal given to the image-signal-line drive circuit 11 is an input signal to be given to the image-signal-line drive circuit itself, the image-signal-line drive circuit 11 operates in master mode. In the example of FIG. 10, the input signal 200 is a signal to be given to the image-signal-line drive circuit 12, and the image-signal-line drive circuit 12 operates as a master. Accordingly, even if the input signal 200 is received, the image-signal-line drive circuit 11 does not operate as a master. The input signal 200 to be given to the image-signal-line drive circuit 11 is illustrated by a dashed line.

When input signals different from each other are simultaneously given to a plurality of image-signal-line drive circuits and all the input signals cause each image-signal-line drive circuit to operate as a master, the liquid crystal display device is configured to determine the image-signal-line drive circuit that operates as a master based on priority preset for each image-signal-line drive circuit. This allows the liquid crystal display device to cope with a case where input signals different from each other are given to a plurality of image-signal-line drive circuits.

In this way, according to the liquid crystal display device 10B of the second preferred embodiment of the present invention, the input signal detecting circuit incorporated in each of the plurality of image-signal-line drive circuits detects whether the given input signal is a signal to be given to the image-signal-line drive circuit itself. When the signal is to be given to the image-signal-line drive circuit itself, the image-signal-line drive circuit can operate as a master, generate a cascade signal and a gate control signal, and control the scanning line drive circuit 13. Accordingly, it is possible to automatically set master and slave of the image-signal-line drive circuit without giving a selection signal from outside.

<Variation>

The above-described second preferred embodiment has described the configuration in which input signals different from each other are given to a plurality of image-signal-line drive circuits. The liquid crystal display device 10B may however be configured so that an identical input signal is given to a plurality of image-signal-line drive circuits, each image-signal-line drive circuit includes the abnormality detecting circuit 31 described with reference to FIG. 7, which automatically switches the slave mode image-signal-line drive circuit to master mode when an abnormality of the master mode image-signal-line drive circuit is detected.

In this case, the input signal detecting circuit 61 of the image-signal-line drive circuit switched from slave mode to master mode does not determine that the input signal is a signal to be given to the image-signal-line drive circuit itself, and does not output the master selection signal 62. It is however possible to select the image-signal-line drive circuit itself as a master by the configuration in which a master/slave switching signal 41 outputted from the abnormality detecting circuit 31 is also given to a master/slave selection circuit 42.

In this way, the abnormality detecting circuit 31 detects an abnormality of the master mode image-signal-line drive circuit, and switches the slave mode image-signal-line drive circuit to master mode automatically. The image-signal-line drive circuit 12 then generates the cascade signal and the gate control signal. This enables backup operation (fail-safe) by the slave when an abnormality occurs in the master.

<Third Preferred Embodiment>

Next, as a third preferred embodiment of the present invention, a configuration will be described in which an input signal detecting circuit is provided outside of an image-signal-line drive circuit, the input signal detecting circuit selects an input signal and gives the input signal together with a master selection signal to a predetermined image-signal-line drive circuit.

Figure 11:
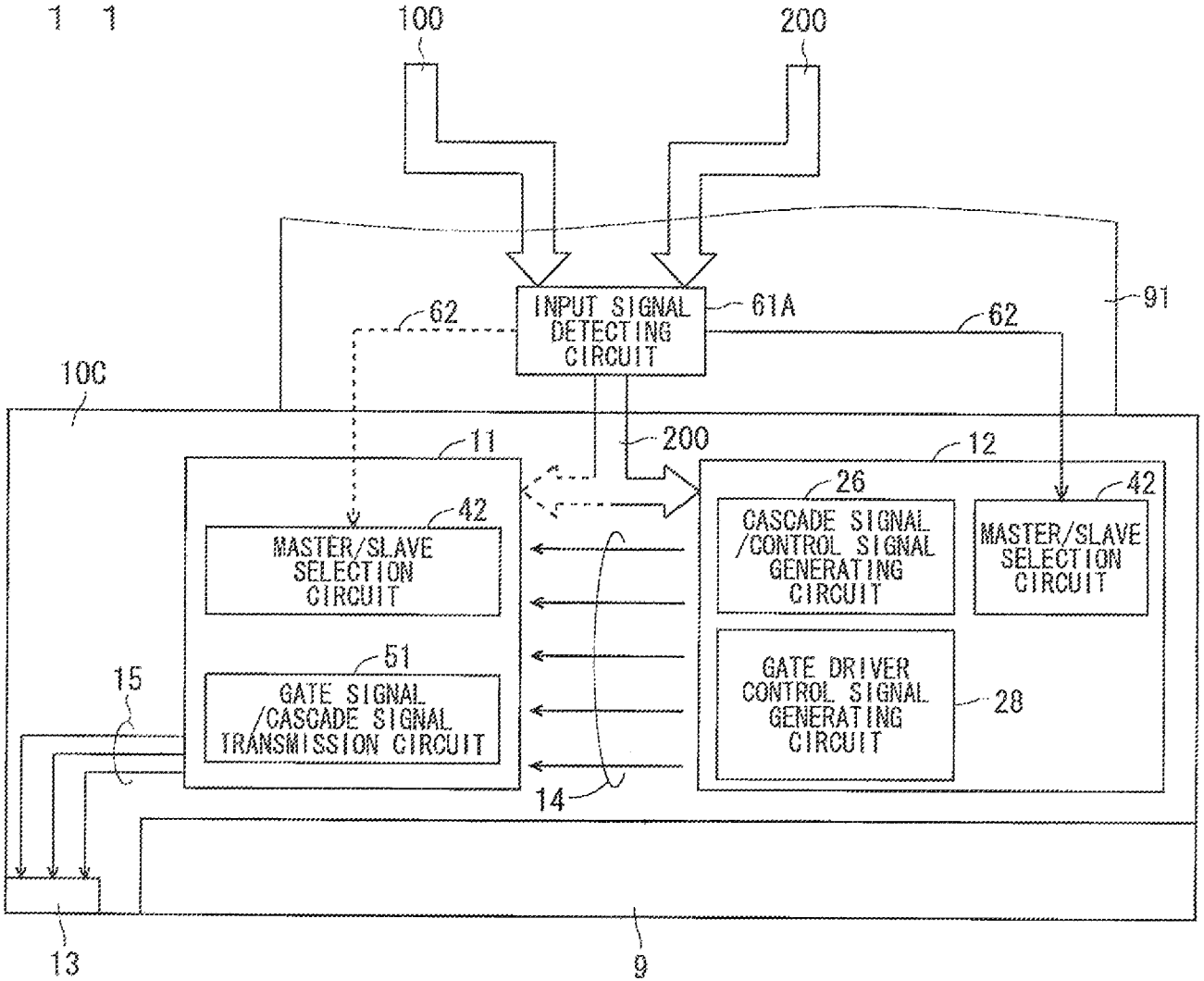
FIG. 11 is a diagram illustrating a configuration of the image-signal-line drive circuit, and an input signal detecting circuit provided on a connection substrate and a signal flow in the liquid crystal display device according to a third preferred embodiment of the present invention.

FIG. 11 is a diagram illustrating a configuration of image-signal-line drive circuits 11 and 12, and an input signal detecting circuit 61A provided on a connection substrate 91, such as a flexible printed circuit (FPC), and a signal flow in a liquid crystal display device 10C of the third preferred embodiment.

As illustrated in FIG. 11, the input signal detecting circuit 61A provided on the connection substrate 91 is configured to receive input signals 100 and 200 given from outside via the connection substrate 91. The input signal detecting circuit 61A detects which of the image-signal-line drive circuits 11 and 12 the input signal is to be given to. For example, when the input signal is to be given to the image-signal-line drive circuit 12, the input signal detecting circuit 61A gives a master selection signal 62 to the image-signal-line drive circuit 12, and gives the input signal 200 to the image-signal-line drive circuit 12.

The input signal detecting circuit 61A may be configured to have, for example, a plurality of input signal detecting circuits 61 described with reference to FIG. 9. A configuration common thereto may include an input data decoder circuit 22, a control signal interface circuit 23, a timing controller 25, a cascade signal/control signal generating circuit 26, and a gate driver control signal generating circuit 28 illustrated in FIG. 9.

That is, the input signal detecting circuit 61A is configured so that each of the outputs of the timing controller 25, the cascade signal/control signal generating circuit 26, and the gate driver control signal generating circuit 28 is inputted in parallel into the plurality of input signal detecting circuits 61.

Each of the plurality of input signal detecting circuits 61 then compares a signal period and voltage level of a control signal with predetermined values. The input signal detecting circuit 61 in which the signal period and the voltage level of the control signal coincide with the predetermined values outputs the master selection signal 62. The predetermined value is determined uniquely for each individual image-signal-line drive circuit.

Each of the plurality of input signal detecting circuits 61 is associated with a predetermined image-signal-line drive circuit on a one-to-one basis. The image-signal-line drive circuit to which the master selection signal 62 is given will operate as a master. In the example of FIG. 11, since the master selection signal 62 is given to select the image-signal-line drive circuit 12 as a master, the master selection signal 62 given to the image-signal-line drive circuit 11 is illustrated by a dashed line.

A master/slave selection circuit 42 to which the master selection signal 62 is given gives a cascade signal and a gate control signal to the image-signal-line drive circuit 11 via a wiring unit 14. The cascade signal is generated in the cascade signal/control signal generating circuit 26 of the image-signal-line drive circuit 12 that operates as a master. The gate control signal is generated in the gate driver control signal generating circuit 28. The cascade signal and the gate control signal are given to a scanning line drive circuit 13 through a gate signal/cascade signal transmission circuit 51 in the image-signal-line drive circuit 11.

The input signal outputted from the input signal detecting circuit 61A is given in common to the plurality of image-signal-line drive circuits. The image-signal-line drive circuit to which the master selection signal 62 is not given however does not operate as a master, and the input signal is not used. In the example of FIG. 11, the input signal 200 is also given to the image-signal-line drive circuit 11 that operates as a slave. Even if the input signal 200 is received, however, the image-signal-line drive circuit 11 does not operate as a master. Accordingly, the input signal 200 given to the image-signal-line drive circuit 11 is illustrated by a dashed line.

The position to dispose the input signal detecting circuit 61A is not limited on the connection substrate 91. The input signal detecting circuit 61A may be disposed on a glass substrate on which the image-signal-line drive circuits 11 and 12 are mounted.

In this way, according to the liquid crystal display device 10C of the third preferred embodiment of the present invention, since the input signal detecting circuit 61A is provided on the connection substrate 91 or the glass substrate, it is possible to make the image-signal-line drive circuit small compared with a case where the input signal detecting circuit 61A is incorporated in the image-signal-line drive circuit.

The liquid crystal display device 10C may be configured so that each of the image-signal-line drive circuits includes the abnormality detecting circuit 31 described with reference to FIG. 7, which automatically switches the slave mode image-signal-line drive circuit to master mode when an abnormality of the master mode image-signal-line drive circuit is detected.

In this way, the abnormality detecting circuit 31 detects the abnormality of the master mode image-signal-line drive circuit, and switches the slave mode image-signal-line drive circuit to master mode automatically. The image-signal-line drive circuit 12 then generates the cascade signal and the gate control signal. This enables backup operation (fail-safe) by the slave when an abnormality occurs in the master.

<Fourth Preferred Embodiment>

Figure 12:
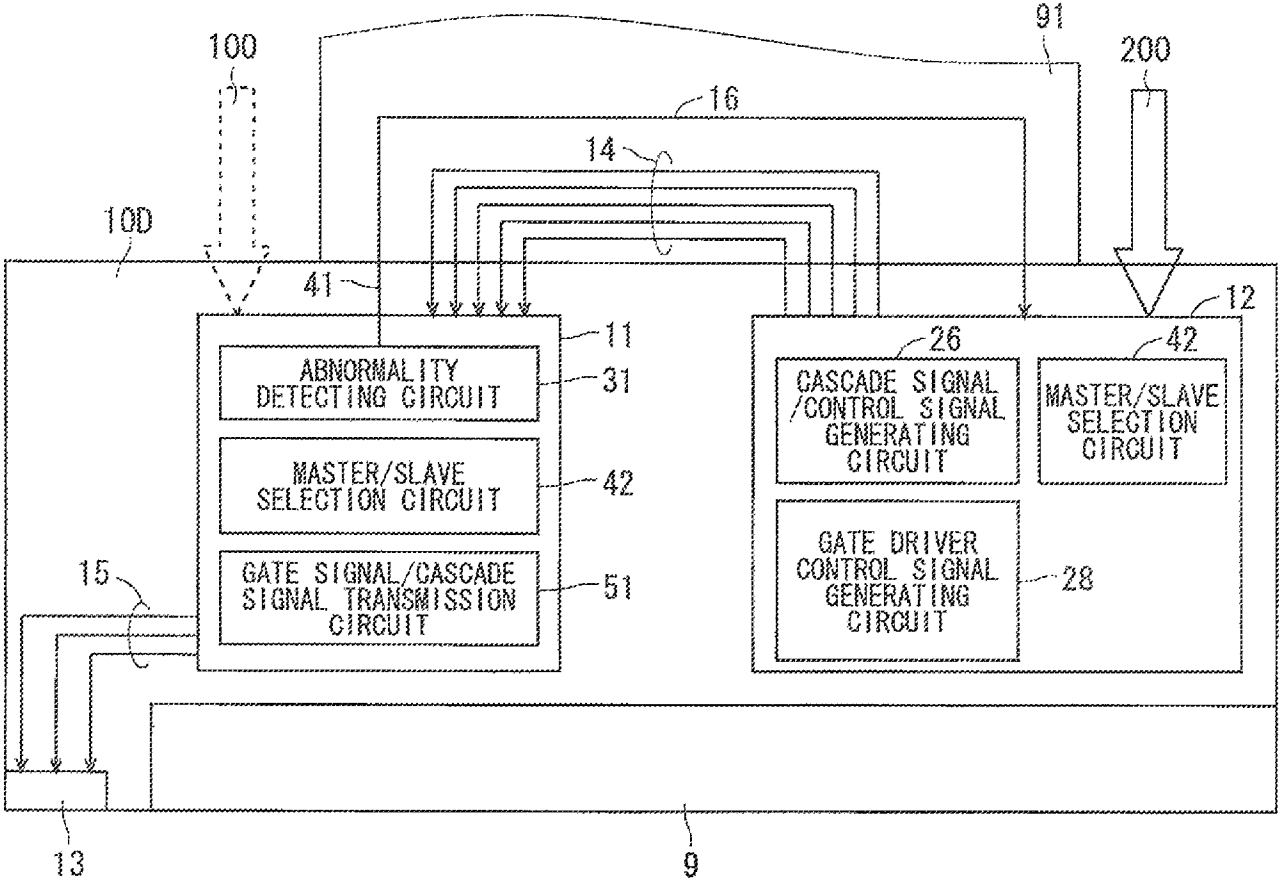
FIG. 12 is a diagram illustrating a configuration of the image-signal-line drive circuit and a signal flow in a wiring unit provided on the connection substrate in the liquid crystal display device according to a fourth preferred embodiment of the present invention.

FIG. 12 is a diagram illustrating a configuration of image-signal-line drive circuits 11 and 12, and a signal flow in a wiring unit 14 provided on a connection substrate 91, such as FPC, in a liquid crystal display device 10D of a fourth preferred embodiment.

As illustrated in FIG. 12, a wiring unit 16 and the wiring unit 14 are disposed on the connection substrate 91. The wiring unit 16 transmits a master/slave switching signal 41 to be outputted from an abnormality detecting circuit 31 provided in the image-signal-line drive circuit 11 that operates as a master when, for example, an abnormality of a timing controller 25 is detected. The wiring unit 14 transmits a cascade signal generated in a cascade signal/control signal generating circuit 26 of the image-signal-line drive circuit 12 that operates as a master at the time of abnormal operation of the image-signal-line drive circuit 11, and a control signal, such as a gate control signal generated in a gate driver control signal generating circuit 28.

When an abnormal operation occurs in the image-signal-line drive circuit 11, the master/slave switching signal 41 outputted from the abnormality detecting circuit 31 is given to a master/slave selection circuit 42 of the image-signal-line drive circuit 12, and the image-signal-line drive circuit 12 operates as a master.

In this way, according to the liquid crystal display device of the fourth preferred embodiment of the present invention, the wiring unit 16 that transmits the master/slave switching signal 41 and the wiring unit 14 that transmits the control signal are provided on the connection substrate 91, such as FPC. This makes it possible to lower resistance compared with a case where the wiring units are provided on a glass substrate and to increase reliability of the liquid crystal display device.

It is needless to say that the wiring unit 14 may be provided on the connection substrate 91 in the liquid crystal display device 10A of the first preferred embodiment illustrated in FIG. 6, the liquid crystal display device 10B of the second preferred embodiment illustrated in FIG. 10, and the liquid crystal display device 10C of the third preferred embodiment illustrated in FIG. 11.

While the invention has been shown and described in detail, the foregoing description is in all aspects illustrative and not restrictive. It is therefore understood that numerous modifications and variations can be devised without departing from the scope of the invention.

What is claimed is:

1. A display device comprising:

a display panel in which a plurality of image signal lines and a plurality of scanning lines are formed in a matrix;

a plurality of image-signal-line drive circuits disposed on a periphery of said display panel, the plurality of image-signal-line drive circuits driving said plurality of image signal lines; and a scanning line drive circuit disposed on a periphery of said display panel, the scanning line drive circuit driving said plurality of scanning lines, each of said plurality of image-signal-line drive circuits including:

a timing controller that generates a control signal controlling itself and other image-signal-line drive circuit; and a master/slave selection circuit that sets itself as either a master mode image-signal-line drive circuit or a slave mode image-signal-line drive circuit based on a selection signal given from outside, wherein, from among said plurality of image-signal-line drive circuits, said master mode image-signal-line drive circuit gives said control signal to said slave mode image-signal-line drive circuit; and wherein each of said plurality of image-signal-line drive circuits further comprises an abnormality detecting circuit that detects an operation abnormality thereof, and when an abnormality is detected, said abnormality detecting circuit outputs a master/slave switching signal to said outside to change said selection signal, to switch said slave mode image-signal-line drive circuit to master mode, and to switch said master mode image-signal-line drive circuit to slave mode.

2. The display device according to claim 1, wherein said abnormality detecting circuit detects a current consumption abnormality of said timing controller in said master mode image-signal-line drive circuit.

3. The display device according to claim 1, wherein said control signal includes a cascade signal and a gate control signal to be given to said plurality of scanning line drive circuits, each of said plurality of image-signal-line drive circuits has a transmission circuit that receives said cascade signal and said gate control signal outputted from a new master mode image-signal-line drive circuit and gives the signals to said scanning line drive circuit when said slave mode image-signal-line drive circuit becomes master mode.

4. A display device comprising:

a display panel in which a plurality of image signal lines and a plurality of scanning lines are formed in a matrix;

a plurality of image-signal-line drive circuits disposed on a periphery of said display panel, the plurality of image-signal-line drive circuits driving said plurality of image signal lines; and a scanning line drive circuit disposed on a periphery of said display panel, the scanning line drive circuit driving said plurality of scanning lines, each of said plurality of image-signal-line drive circuits including:

a timing controller that generates a control signal controlling itself and other image-signal-line drive circuit based on an input signal for driving the image signal line;

an input signal detecting circuit that detects said input signal, detects whether said input signal is a signal to be given to itself, and outputs a master selection signal for setting itself as a master mode image-signal-line drive circuit when the input signal is a signal to be given to itself; and a master/slave selection circuit that receives said master selection signal and sets itself as either said master mode image-signal-line drive circuit or a slave mode image-signal-line drive circuit, wherein, from among said plurality of image-signal-line drive circuits, said master mode image-signal-line drive circuit gives said control signal to said slave mode image-signal-line drive circuit; and wherein each of said plurality of image-signal-line drive circuits further comprises an abnormality detecting circuit that detects an operation abnormality thereof, and when an abnormality is detected, said abnormality detecting circuit gives a master/slave switching signal to said master/slave selection circuit of said master mode image-signal-line drive circuit and said master/slave selection circuit of said slave mode image-signal-line drive circuit, switches said slave mode image-signal-line drive circuit to master mode, and switches said master mode image-signal-line drive circuit to slave mode.

5. The display device according to claim 4, wherein said input signal detecting circuit detects whether said input signal is a signal to be given to itself by detecting whether a period and a voltage level of said control signal coincide with specified values unique to itself.

6. The display device according to claim 4, wherein said control signal includes a cascade signal and a gate control signal to be given to said plurality of scanning line drive circuits, each of said plurality of image-signal-line drive circuits has a transmission circuit that receives said cascade signal and said gate control signal outputted from a new master mode image-signal-line drive circuit and gives the signals to said scanning line drive circuit when said slave mode image-signal-line drive circuit becomes master mode.

7. A display device comprising:

a display panel in which a plurality of image signal lines and a plurality of scanning lines are formed in a matrix;

a plurality of image-signal-line drive circuits disposed on a periphery of said display panel, the plurality of image-signal-line drive circuits driving said plurality of image signal lines;

a scanning line drive circuit disposed on a periphery of said display panel, the scanning line drive circuit driving said plurality of scanning lines; and an input signal detecting circuit provided in outside of said plurality of image-signal-line drive circuits, the input signal detecting circuit detecting an input signal for driving the image signal line, the input signal detecting circuit detecting which of said plurality of image-signal-line drive circuits said input signal is to be given to, the input signal detecting circuit outputting a master selection signal for setting an applicable image-signal-line drive circuit as a master mode image-signal-line drive circuit, each of said plurality of image-signal-line drive circuits including:

a timing controller that generates a control signal controlling itself and other image-signal-line drive circuit based on said input signal; and a master/slave selection circuit that receives said master selection signal and sets itself as either said master mode image-signal-line drive circuit or a slave mode image-signal-line drive circuit, wherein, from among said plurality of image-signal-line drive circuits, said master mode image-signal-line drive circuit gives said control signal to said slave mode image-signal-line drive circuit; and wherein each of said plurality of image-signal-line drive circuits further comprises an abnormality detecting circuit that detects an operation abnormality thereof, and when an abnormality is detected, said abnormality detecting circuit gives a master/slave switching signal to said master/slave selection circuit of said master mode image-signal-line drive circuit and said master/slave selection circuit of said slave mode image-signal-line drive circuit, switches said slave mode image-signal-line drive circuit to master mode, and switches said master mode image-signal-line drive circuit to slave mode.

8. The display device according to claim 7, wherein said input signal detecting circuit has a configuration identical to that of said timing controller included in said plurality of image-signal-line drive circuits, and detects whether said input signal is a signal to be given to any one of said plurality of image-signal line drive circuits by detecting whether a period and a voltage level of said control signal which said timing controller outputs coincide with specified values unique to any one of said plurality of image-signal line drive circuits.

9. The display device according to claim 7, wherein said abnormality detecting circuit detects a current consumption abnormality of said timing controller in said master mode image-signal-line drive circuit.

10. The display device according to claim 7, wherein said control signal includes a cascade signal and a gate control signal to be given to said plurality of scanning line drive circuits, each of said plurality of image-signal-line drive circuits has a transmission circuit that receives said cascade signal and said gate control signal outputted from a new master mode image-signal-line drive circuit and gives the signals to said scanning line drive circuit when said slave mode image-signal-line drive circuit becomes master mode.

* * * * *